US005295892A

United States Patent [19]

Felton

[11] Patent Number: 5,295,892

[45] Date of Patent: Mar. 22, 1994

[54] BALLOON HAVING A SELF SEALING VALVE AND METHOD OF MAKING SAME

[75] Inventor: Rick L. Felton, Festus, Mo.

[73] Assignee: Show-Me Balloons, Festus, Mo.

[21] Appl. No.: 971,194

[22] Filed: Nov. 4, 1992

[51] Int. Cl.[5] ..... A63H 3/06

[52] U.S. Cl. ..... 446/224; 446/220

[58] Field of Search ..... 446/220, 222, 224, 225, 446/226

[56] References Cited

U.S. PATENT DOCUMENTS

| | | | |
|---|---|---|---|
| 3,113,551 | 12/1963 | Korn | 446/220 X |
| 3,491,791 | 1/1970 | Polk . | |
| 3,664,058 | 5/1972 | Brieske . | |
| 3,822,720 | 7/1974 | Souza . | |
| 4,674,532 | 6/1987 | Koyanagi . | |
| 4,708,167 | 11/1987 | Koyanagi . | |
| 4,758,198 | 7/1988 | Ishiwa | 446/224 X |
| 4,837,955 | 6/1989 | Grabhorn | 446/220 X |
| 4,842,007 | 6/1989 | Kurtz | 446/220 X |
| 4,917,646 | 4/1990 | Kieves . | |
| 4,983,138 | 1/1991 | McGrath . | |
| 5,108,339 | 4/1992 | Kieves . | |
| 5,188,558 | 2/1993 | Barton et al. | 446/220 X |

FOREIGN PATENT DOCUMENTS

| | | | |
|---|---|---|---|
| 7900569 | 8/1979 | PCT Int'l Appl. | 446/220 |

*Primary Examiner*—David N. Muir

*Attorney, Agent, or Firm*—Senniger, Powers, Leavitt & Roedel

[57] ABSTRACT

A balloon comprising first and second balloon sheets and a self-sealing valve positioned between the balloon sheets. Each balloon sheet has a body portion and a stem portion extending outwardly from the body portion and terminating at a stem end. The balloon sheets are bonded together generally around their peripheries to define a balloon body and balloon stem. The stem portion of the first balloon sheet is shorter than the stem portion of the second balloon sheet so that the stem end of the second balloon sheet extends beyond the stem end of the first balloon sheet to define an extended portion of the second balloon sheet. The valve comprises first and second valve sheets each having an inlet end, an outlet end, and an intermediate region between the inlet and outlet ends. The inlet end of the second valve sheet extends outwardly beyond the inlet end of the first valve sheet to define an extended portion of the second valve sheet. The valve is disposed between and bonded to the balloon sheets generally at the balloon stem with the inlet end of the second valve sheet overlying the extended portion of the second balloon sheet. The extended portion of the second balloon sheet and the extended portion of the second valve sheet combine to form a guide tongue for facilitating insertion of a gas supply nozzle into the valve during inflation of the balloon.

7 Claims, 3 Drawing Sheets

BALLOON HAVING A SELF SEALING VALVE AND METHOD OF MAKING SAME

BACKGROUND OF THE INVENTION

This invention relates to balloons and, in particular, to a balloon having a self-sealing valve.

Exemplary of presently existing self-sealing balloons is the balloon shown in U.S. Pat. No. 4,708,167 having a valve positioned in and bonded to the stem of the balloon. The valve is formed from two valve sheets bonded together to define a valve inlet and a valve outlet, and the valve is so positioned in the balloon that the valve inlet extends outwardly beyond the balloon stem. The inside surface of one of the valve sheets is coated with a bond-resistant coating to prevent bonding of the valve sheets together during bonding of the valve to the balloon. The valve sheets are generally thin and therefore often difficult to separate at the valve inlet, making it difficult to insert a gas supply nozzle to inflate the balloon. Also, although the self-sealing valve functions to resist leakage of gas out the stem of the balloon without permanently sealing the stem, in some circumstances it is desirable to permanently close the valve by a heat-seal across the balloon stem after inflation of the balloon. This cannot be accomplished in the aforementioned prior art balloon since the bond-resistant coating on the valve prevents heat-sealing of the valve in the stem area of the balloon.

In another prior art balloon, the valve lies entirely within the balloon and extends from a portion of the stem adjacent the body of the balloon into the body. A disadvantage of this balloon is that the valve is not visible when the balloon is assembled. If the valve is not properly positioned in the balloon during assembly—e.g., due to a malfunction in the assembly process—the defect in the balloon cannot be visually detected. Also, since the valve is not positioned in the end of the stem, the thickness of the stem is no greater than the thickness of the balloon sheet. Thus, a string tied to the end of the stem may tear the stem because the stem is not reinforced.

SUMMARY OF THE INVENTION

Among the objects of the present invention may be noted the provision of an improved balloon having a self-sealing valve; the provision of such a balloon in which a gas supply nozzle may be easily inserted into the valve inlet; the provision of such a balloon in which the valve inlet is capable of being heat-sealed after inflation of the balloon to seal the inlet of the valve against leakage of gas; the provision of such a balloon in which the position of the valve in the balloon may be visually inspected when the balloon is assembled; and the provision of such a balloon in which the stem is reinforced by the valve to resist tearing of the stem by a string tied thereto. Also among the objects of the present invention may be noted the provision of an improved method of making a balloon which is simple and economical.

The balloon of this invention comprises first and second balloon sheets each having a body portion and a stem portion extending outwardly from the body portion and terminating at a stem end. The balloon sheets are bonded together generally around their peripheries to define a balloon body and balloon stem. The stem portion of the first balloon sheet is shorter than the stem portion of the second balloon sheet so that the stem end of the second balloon sheet extends beyond the stem end of the first balloon sheet to define an extended portion of the second balloon sheet when the first and second balloon sheets are bonded together. The balloon also includes a self-sealing valve comprising first and second valve sheets each having an inlet end, an outlet end, and an intermediate region between the inlet and outlet ends. The valve sheets are positioned face-to-face and bonded together to define a valve inlet and a valve outlet. The inlet end of the second valve sheet extends outwardly beyond the inlet end of the first valve sheet to define an extended portion of the second valve sheet when the first and second valve sheets are bonded together. The valve is disposed between and bonded to the first and second balloon sheets generally at the balloon stem with the inlet end of the second valve sheet overlying the extended portion of the second balloon sheet. The extended portion of the second balloon sheet and the extended portion of the second valve sheet combines to form a guide tongue for facilitating insertion of a gas supply nozzle into the valve inlet during inflation of the balloon.

This invention also relates to a method of making a balloon. The method involves bonding first and second flexible valve sheets together in face-to-face relation to form a self-sealing valve having a valve inlet and a valve outlet. The first and second flexible valve sheets each have an inlet end, an outlet end, and an intermediate region between the inlet end and the outlet end. The inlet end of the second valve sheet extends beyond the inlet end of the first valve sheet to define an extended portion of the second valve sheet. The valve is bonded to one of first and second balloon sheets. Each balloon sheet has a body portion and a stem portion extending outwardly from the body portion and terminating at a stem end. The stem portion of the first balloon sheet is shorter than the stem portion of the second balloon sheet. The first balloon sheet is positioned generally face-to-face with the second balloon sheet, and with at least a portion of the valve disposed between the stem portions of the first and second balloon sheets. The first and second balloon sheets are bonded together generally around the periphery of the balloon sheets with the stem end of the second balloon sheet extending beyond the stem end of the first balloon sheet to define an extended portion of the second balloon sheet, and with the inlet end of the second valve sheet overlying the extended portion of the second balloon sheet. The extended portion of the second balloon sheet and the extended portion of the second valve sheet combine to form a guide tongue for facilitating insertion of a gas supply nozzle into the valve inlet during inflation of the balloon.

These and other advantages and features of the present invention will be in part apparent and in part pointed out hereinafter.

BRIEF DESCRIPTION OF THE DRAWINGS

FIG. 5 is a schematic view of an apparatus for making the balloon of the present invention.

Corresponding reference characters indicate corresponding parts throughout the several views of the drawings.

DETAILED DESCRIPTION OF THE PREFERRED EMBODIMENTS

Figure 1:
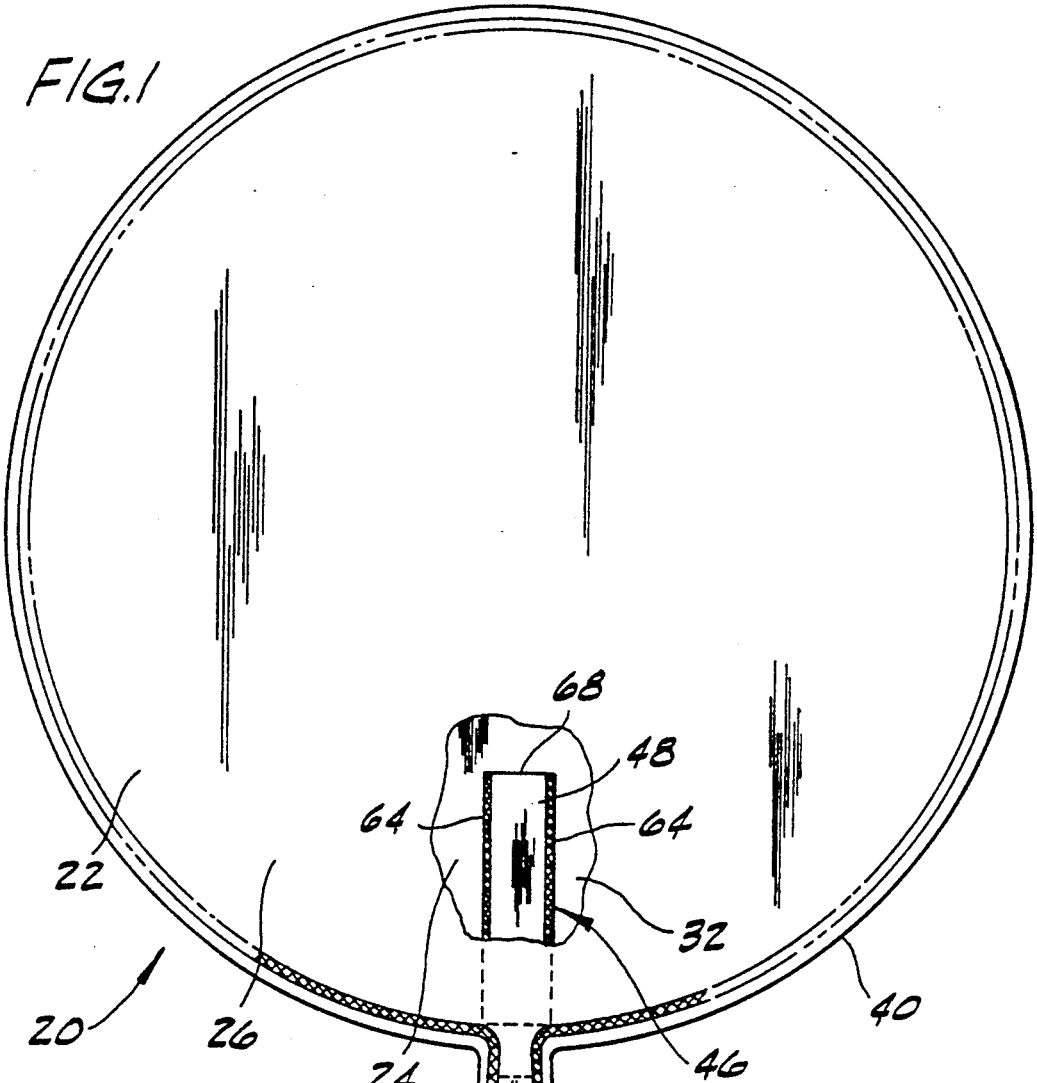
FIG. 1 is a view of a balloon of the present invention with portions of the balloon broken away to show a self-sealing valve.
Figure 3:
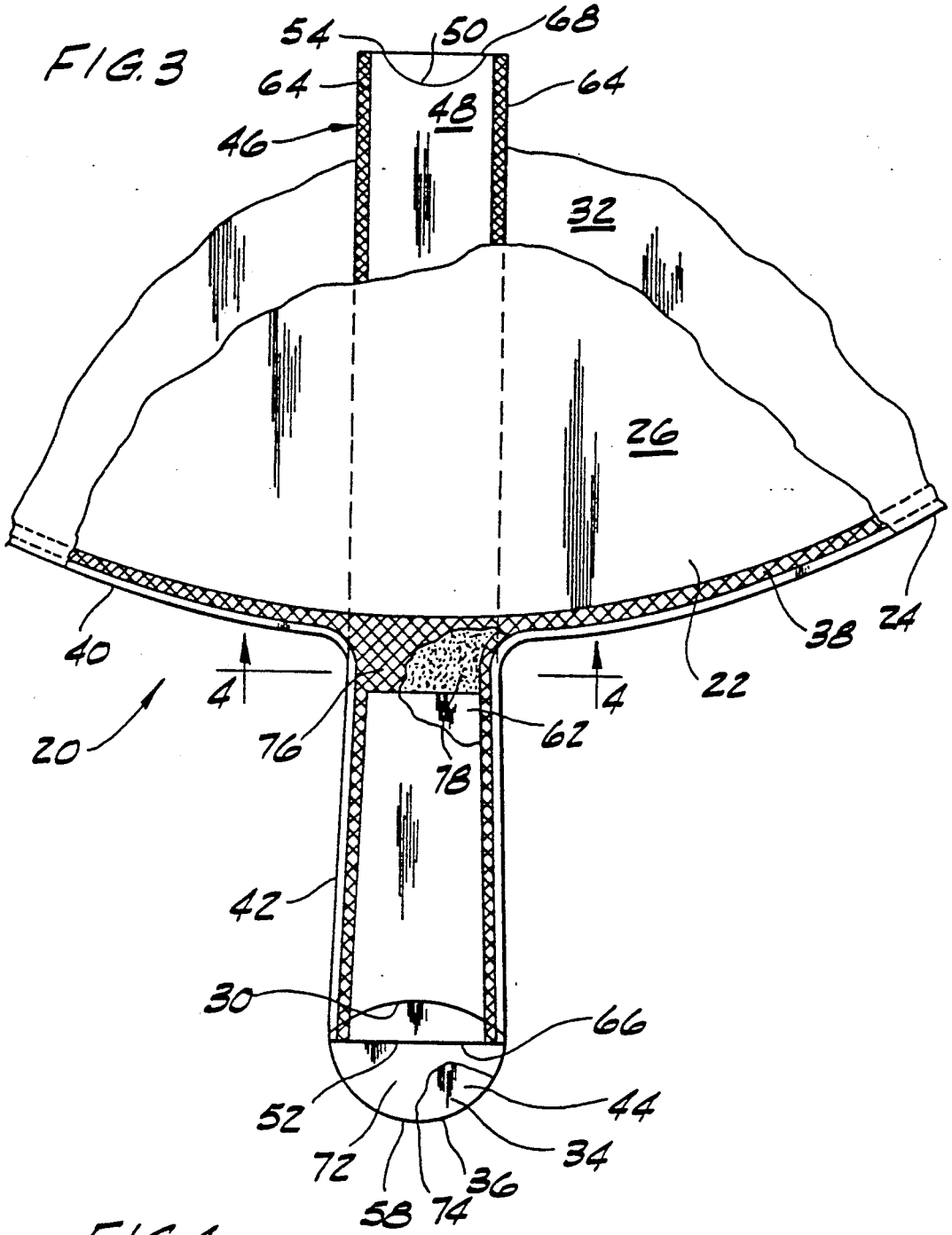
FIG. 3 is an enlarged view of a portion of the balloon of FIG. 1 showing the valve and stem.

A balloon made according to the principles of this invention is indicated generally at 20 in FIGS. 1 and 3. The balloon 20 comprises first and second balloon sheets 22 and 24, preferably made of a heat-sealable flexible sheet material, such as 48-gauge metalized nylon sheet material. The first balloon sheet 22 has a body portion 26 and a stem portion 28 extending outwardly from the body portion 26 and terminating at a stem end 30. Likewise, the second balloon sheet 24 has a body portion 32 and a stem portion 34 (FIG. 3) extending outwardly from the body portion 32 and terminating at a stem end 36. The balloon sheets 22 and 24 are bonded together face-to-face, preferably by heat-sealing, to form a gas-impermeable joint or seam 38 along the periphery of the balloon sheets 22 and 24. The body portions 26 and 32 of the balloon sheets combine to define a balloon body 40 and the stem portions 28 and 34 of the balloon sheets combine to define a balloon stem 42. As shown in FIG. 3, the stem portion 28 of the first balloon sheet 22 is shorter than the stem portion 34 of the second balloon sheet 24 so that the stem end 36 of the second balloon sheet 24 extends beyond the stem end 30 of the first balloon sheet 22 to define an extended portion 44 of the stem portion 34 of the second balloon sheet 24 when the first and second balloon sheets 22 and 24 are bonded together.

Figure 2:
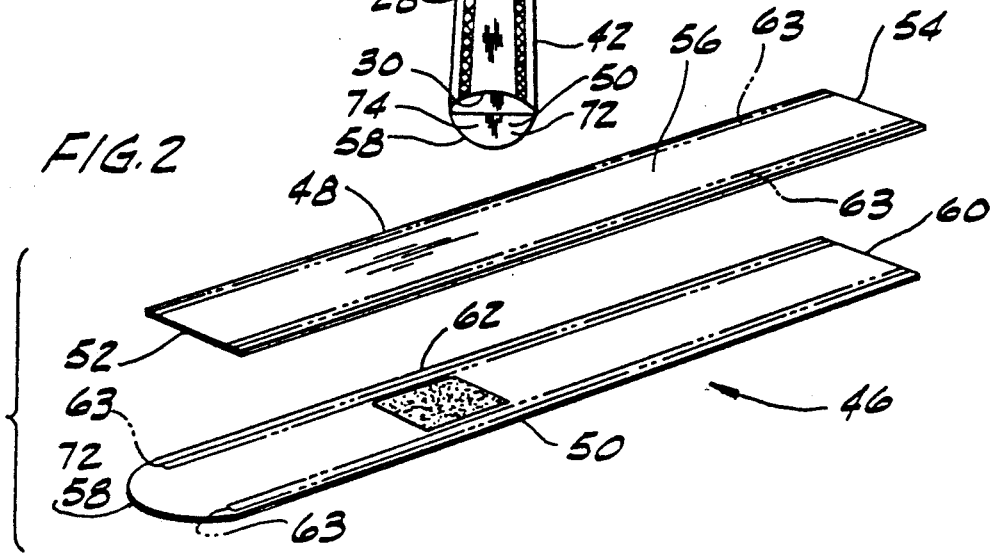
FIG. 2 is an exploded perspective view of the valve of FIG. 1.

A self-sealing valve, generally designated at 46 (see FIGS. 1–4), is positioned between the balloon sheets 22 and 24 and bonded to the stem portions 28 and 34 of the balloon sheets 22 and 24. The valve 46 comprises first and second elongate flexible valve sheets 48 and 50, made of a heat-sealable polymeric resin. The first valve sheet 48 has an inlet end 52, an outlet end 54, and an intermediate region 56 between the inlet and outlet ends 52 and 54. Similarly, the second valve sheet 50 has an inlet end 58, an outlet end 60, and an intermediate region 62 between its inlet and outlet ends 58 and 60. The valve sheets 48 and 50 are positioned face-to-face and bonded together, preferably by heat sealing, along their side edge margins 63 (FIG. 2) to form gas-impermeable edge seals 64 (FIG. 3), thereby defining a valve inlet 66, a valve outlet 68 extending into the balloon body 40, and a passageway 70 (see FIG. 4) between the inlet and outlet 66 and 68. The inlet end 58 of the second valve sheet 50 extends outwardly beyond the inlet end 52 of the first valve sheet 48 to define an extended portion 72 of the second valve sheet 50 when the first and second valve sheets 48 and 50 are bonded together.

The valve 46 is bonded to the balloon stem 42 at the joint 38 with the inlet end 58 of the second valve sheet 50 overlying the extended portion 44 of the second balloon sheet 24. The extended portion 44 of the second balloon sheet 24 and the extended portion 72 of the second valve sheet 50 combine to form a reinforced guide tongue 74 for facilitating insertion of a gas supply nozzle (not shown) into the valve inlet 66 prior to inflation of the balloon 20. Preferably, the inlet end 58 of the second valve sheet 50 is generally coterminous with and bonded to the stem end 36 of the second balloon sheet 24. The guide tongue 74 also constitutes a reinforced region for accommodating a string tied to the balloon stem 42. The guide tongue 74 will resist tearing by a string threaded through a hole (not shown) punched through the guide tongue 74.

Figure 4:
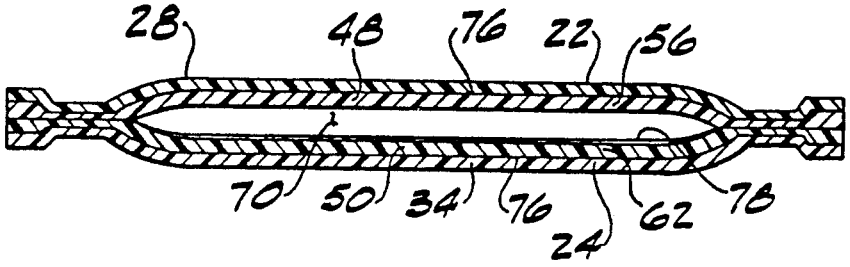
FIG. 4 is an enlarged section view taken along the line 4—4 of FIG. 3.
Figure 3:
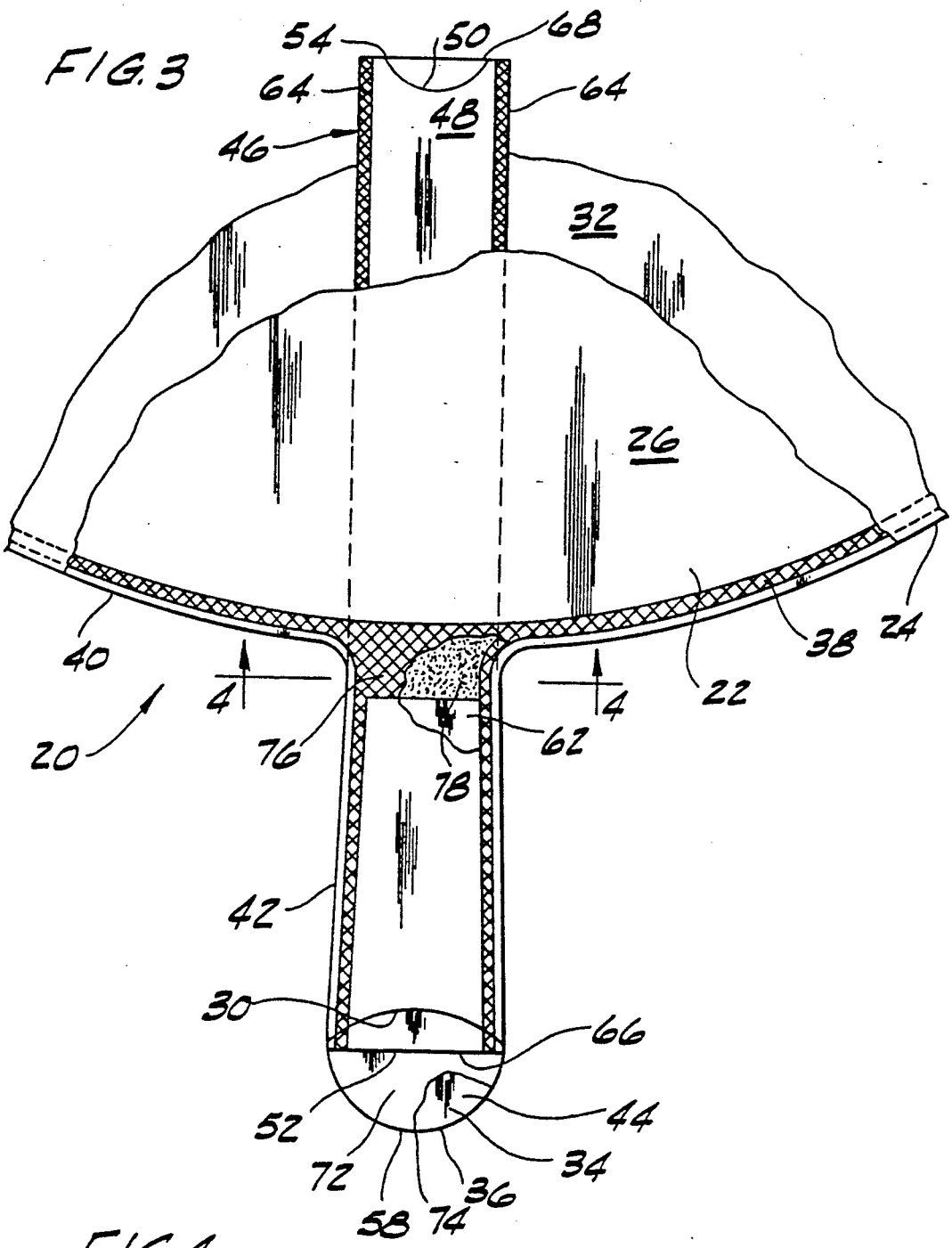
Figure 4:
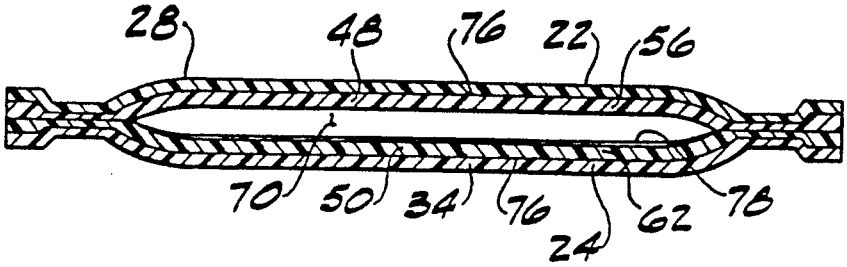

As shown in FIGS. 3 and 4, the intermediate regions 56 and 62 of the valve sheets 48 and 50 are bonded across their widths to the stem portions 28 and 34 of respective balloon sheets 22 and 24 generally where the balloon stem 42 meets the balloon body 40 to form seals 76 for preventing gas in the balloon body 40 from leaking between the valve 46 and the balloon stem 42. The inner surface of the intermediate region 62 of the second valve sheet 50 is coated with a bond-resistant agent 78, such as heat-resistant ink, to prevent bonding of the valve sheets 48 and 50 to one another when the seals 76 are formed. While the intermediate region 62 of the second valve sheet 50 has been described as being coated with the bond-resistant agent 78, it is to be understood that, alternatively, the intermediate region 56 of the first valve sheet 48 could be coated with the bond-resistant agent without departing from the principles of this invention. Also, although the valve passageway 70 is shown as being open in FIG. 4, it is to be understood that the passageway 70 is open only when the balloon 20 is being inflated. Preferably, the inlet ends 52 and 58 of the valve sheets 48 and 50 are free of the bond-resistant agent so that the inlet end 52 of the first valve sheet 48 may be bonded to the second valve sheet 50 after inflation of the balloon 20 to form a permanent seal (not shown) at the valve inlet 66 for preventing leakage of gas back out the inlet 66.

Referring to FIG. 5, the balloon sheets 22 and 24 are formed from thin heat-sealable flexible material supplied from first and second rolls 80 and 82. A first web 84 of the material is fed from the first roll 80 to a hole forming station 86, then to a valve attaching station 88, then to a balloon sealing station 90, and then to a balloon cutting station 92. A second web 94 of the material is fed from the second roll 82 to the balloon sealing station 90 and then to the balloon cutting station 92.

A hole (not shown) is punched in the first web 84 by a hole punch 96 at the hole forming station 86 to form the stem end 30 (see FIG. 3) of the first balloon sheet 22. Web 84 then travels to the valve attaching station 88 where a vacuum grip 98 holds a valve 46 (already assembled) and positions it so that the first valve sheet 48 contacts the first web 84 and the extended portion 72 of the second valve sheet 50 overlays the hole punched at the hole forming station 86. With the valve 46 held in position by the vacuum grip 98, the side edge margins of the valve 46 are tacked to the first web 84 by a heat-sealing die 100. Prior to the sealing station 90, the first and second webs 84 and 94 are brought into face-to-face registry with the valve 46 positioned between the two webs. The webs 84 and 94 and valve 46 then travel to the balloon sealing station 90 where a heat-sealing press 102 forms the gas-impermeable joint 38 and the seals 76. The bond resistant agent 78 prevents the valve sheets 48 and 50 from bonding together when the seals 76 are formed. The webs 84 and 94 are then fed forward to the balloon cutting station 92 where they are cut by a cutting die 104 generally around the joint 38 to form the balloon sheets 22 and 24. Preferably, the cutting die 104 includes a heated cutting blade (not shown) which heat-seals the edges of the balloon sheets 22 and 24 together as the balloon sheets 22 and 24 are formed. The cutting blade also preferably cuts away any part of the second valve sheet 50 which extends beyond the stem end 36 of the second balloon sheet 24, and heat-seals the inlet end 58 of the second valve sheet 50 to the stem end 36 of the second balloon sheet 24. Thus, the inlet end 58 of the second valve sheet 50 is coterminous with and bonded to the stem end 36 of the second balloon sheet 24.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A balloon comprising:

first and second balloon sheets each having a body portion and a stem portion extending outwardly from the body portion and terminating at a stem end, the body portion and stem portion of each sheet defining a periphery, said balloon sheets being bonded together generally around their peripheries to define a balloon body and balloon stem, the stem portion of said first balloon sheet being shorter than the stem portion of said second balloon sheet so that the stem end of said second balloon sheet extends beyond the stem end of said first balloon sheet to define an extended portion of said second balloon sheet when said first and second balloon sheets are bonded together, the stem portions of said balloon sheets having edge margins extending from adjacent the body portions to adjacent their stem ends; and a self-sealing valve comprising first and second valve sheets each having an inlet end, an outlet end, and an intermediate region between the inlet and outlet ends, said valve sheets being positioned face-to-face and bonded together to define a valve inlet and a valve outlet, the inlet end of said second valve sheet extending outwardly beyond the inlet end of said first valve sheet to define an extended portion of said second valve sheet when said first and second valve sheets are bonded together;

said valve being disposed between and bonded to said first and second balloon sheets generally at the balloon stem with the inlet end of said second valve sheet overlying the extended portion of said second balloon sheet and being coterminous with the stem end of said second balloon sheet, said valve being bonded to said balloon sheets along the edge margins of the balloon stems to form first and second edge seals extending from adjacent the body portion of balloon sheets to adjacent the stem ends, the extended portion of said second balloon sheet and the extended portion of said second valve sheet being bonded together to form a guide tongue for facilitating insertion of a gas supply nozzle into the valve inlet during inflation of the balloon.

2. A balloon as set forth in claim 1 wherein the inlet end of said second valve sheet is bonded to the stem end of said second balloon sheet.

3. A balloon as set forth in claim 2 wherein the intermediate regions of said first and second valve sheets are bonded to said first and second balloon sheets, respectively, across said valve sheets to form a seal for preventing gas in the balloon body from leaking between the valve and stem.

4. A balloon as set forth in claim 3 wherein said seal is adjacent the stem portions of said balloon sheets.

5. A balloon as set forth in claim 3 further comprising a bond-resistant agent on an inner surface of one of said first and second valve sheets at the intermediate region of said one valve sheet for preventing bonding of the first and second valve sheets to one another when said seal is formed.

6. A balloon as set forth in claim 5 wherein the inlet ends of said first and second valve sheets are free of said bond-resistant agent so that the inlet end of the first valve sheet may be bonded to the second valve sheet after inflation of the balloon to seal the inlet of said valve against leakage of gas out the inlet of said valve.

7. A method of making a balloon comprising the steps of:

bonding first and second flexible valve sheets together in face-to-face relation to form a self-sealing valve having a valve inlet and a valve outlet, said first and second flexible valve sheets each having an inlet end, an outlet end, and an intermediate region between the inlet end and the outlet end, a bond resistant agent being within the valve sheets for selectively preventing bonding of the intermediate regions of the valve sheets, the inlet end of said second valve sheet extending beyond the inlet end of said first valve sheet to define an extended portion of said second valve sheet;

bonding the valve to one of first and second balloon sheets, each balloon sheet having a body portion and a stem portion extending outwardly from the body portion and terminating at a stem end, the stem portion of said first balloon sheet being shorter than the stem portion of said second balloon sheet, the stem portions of said balloon sheets having edge margins extending from adjacent the body portions to their stem ends;

positioning said first balloon sheet generally face to face with said second balloon sheet, and with at least a portion of said valve being disposed between the stem portions of said first and second balloon sheets;

bonding said valve to said balloon sheets along the edge margins of the stems of said balloon sheets to form first and second edge seals extending from adjacent the body portions of said balloon sheets to adjacent the stem ends of said balloon sheets; and bonding said first and second balloon sheets together generally around the periphery of said balloon sheets with the stem end of said second balloon sheet extending beyond the stem end of said first balloon sheet to define an extended portion of said second balloon sheet, and with the inlet end of said second valve sheet overlying the extended portion of said second balloon sheet and being coterminous with the stem end of the second balloon sheet, the extended portion of said second balloon sheet and the extended portion of said second valve sheet combining to form a guide tongue for facilitating insertion of a gas supply nozzle into the valve inlet during inflation of the balloon.

* * * * *